US008141996B2

(12) United States Patent
Katoh

(10) Patent No.: US 8,141,996 B2
(45) Date of Patent: Mar. 27, 2012

(54) LIQUID EJECTING DEVICE AND IMAGE FORMING APPARATUS

(75) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 335 days.

(21) Appl. No.: 12/470,747

(22) Filed: May 22, 2009

(65) Prior Publication Data

US 2009/0290002 A1 Nov. 26, 2009

(30) Foreign Application Priority Data

May 26, 2008 (JP) ..... 2008-136842

(51) Int. Cl.
*B41J 2/175* (2006.01)

(52) U.S. Cl. ..... 347/85

(58) Field of Classification Search ..... None
See application file for complete search history.

(56) References Cited

U.S. PATENT DOCUMENTS

| | | | | |
|---|---|---|---|---|
| 6,682,185 | B2 | 1/2004 | Hashimoto et al. | |
| 6,913,348 | B2 | 7/2005 | Hashimoto et al. | |
| 7,325,908 | B2 | 2/2008 | Katoh et al. | |
| 7,364,253 | B2 | 4/2008 | Hashimoto et al. | |
| 2004/0174417 | A1 * | 9/2004 | Kobayashi et al. | 347/85 |
| 2006/0209140 | A1 * | 9/2006 | Nagai | 347/85 |
| 2007/0008356 | A1 | 1/2007 | Katoh | |
| 2008/0158294 | A1 | 7/2008 | Katoh | |
| 2008/0273046 | A1 * | 11/2008 | Ishinaga et al. | 347/6 |
| 2009/0051724 | A1 | 2/2009 | Katoh | |

FOREIGN PATENT DOCUMENTS

| | | |
|---|---|---|
| JP | 3252392 | 11/2001 |
| JP | 2006-88564 | 4/2006 |
| JP | 2007-313817 | 12/2007 |
| WO | WO95/31335 | 11/1995 |
| WO | WO 2005118300 A1 * | 12/2005 |

* cited by examiner

*Primary Examiner* — Matthew Luu
*Assistant Examiner* — Erica Lin
(74) *Attorney, Agent, or Firm* — Cooper & Dunham LLP

(57) ABSTRACT

Disclosed is a liquid ejecting device including a liquid ejecting head including a liquid ejecting nozzle, a head tank configured to store liquid to be fed to the liquid ejecting head, a liquid storing container configured to store liquid to be fed to the head tank, a first liquid sending device configured to send liquid from the liquid storing container to the head tank, a pressure adjusting tank configured to store liquid suctioned from the liquid ejecting head, and a second liquid sending device configured to send liquid from the liquid ejecting head to the pressure adjusting tank, wherein the head tank includes a liquid receiving port configured to receive liquid from the liquid storing container via a liquid receiving valve being opened at a predetermined or less pressure and a liquid feeding port configured to feed liquid to the liquid ejecting head and the liquid ejecting head includes a liquid inflow port communicating with the liquid feeding port and a liquid outflow port communicating with the pressure adjusting tank via the second liquid sending device.

16 Claims, 14 Drawing Sheets

AA CROSS-SECTION

AA CROSS-SECTION

LIQUID EJECTING DEVICE AND IMAGE FORMING APPARATUS

BACKGROUND

1. Technical Field

This disclosure relates to a liquid ejecting device and an image forming apparatus including the same.

2. Description of Related Art

As on-demand-type ink jet (IJ) recording techniques, there have been well-known an ink ejecting method in which a vibration plate is provided on a part of the wall of a liquid chamber filled with ink and the vibrating plate is displaced by a piezoelectric actuator or the like so as to change the volume of the liquid chamber and increase the pressure therein, and an ink ejecting method in which a heater to be heated by its energization is provided in a liquid chamber and the inner pressure of the liquid chamber is increased by means of air bubbles generated by heating of the heater. Recently, the IJ technique has been applied not only to a low-price printer but also to image formation for a wide-format poster, a sign board and the like. In a business application or an industrial application, particularly, for improvement of image formation throughput, that is, speeding-up of an image formation rate, are desired, and a method of feeding ink (re-fill) from a high-capacity ink cartridge installed in its body through a tube into a head tank (also called a sub-tank) on the top of a head has been commonly used. When such an ink refill method using a tube is applied, it is possible to lighten and miniaturize its carriage part and accordingly it is possible to miniaturize an apparatus including its structural system and driving system greatly.

As increase of the number of nozzle heads for further improvement of a printing throughput, increase of the flow rate of ink liquid to be fed due to attainment of a high head-driving frequency, and a high viscosity of ink for its short time drying are attained, a problem of insufficient refilling occurs due to the pressure loss of the fluid resistance of a tube. Because the length of a tube is large, particularly, in an apparatus for recording on a large-sized printing medium, the pressure loss is large accordingly and the problem is serious.

Against such a problem, as an ink feeding system disclosed in Japanese Patent Publication Application No. 2006-088564, it may be useful to pressurize ink at its feeding side and to provide a differential pressure regulating valve at the upstream side of a sub-tank whereby ink is fed when the negative pressure of the inside of the sub-tank is greater than a predetermined pressure. The ink feeding system disclosed therein is configured to circulate ink through a reservoir tank fixed on its body and the sub-tank mounted on a carriage whereby it is possible to discharge air bubbles together with the ink. Then, there is provided a difference between the fluid resistances of the feeding route and return route of an ink circulating route, so that the sub-tank is kept at a pressurization state by an ink circulating pressure. A recording head is connected to the sub-tank through the differential pressure regulating valve, and is configured such that ink is fed from the sub-tank to the recording head when the recording head has a predetermined or less negative pressure. Thereby, the aforementioned insufficient refilling may be solved. However, because ink in the sub-tank is merely circulated through the upstream reservoir tank and air bubbles generating in a recording head are merely discharged by means of suction in the ink feeding system, the important efficiency of air bubble discharge of the recording head is insufficient and there is a problem in the stability of ink ejection from a nozzle. In particular, when the length of the head is increased, the efficiency of air bubble discharge may be deteriorated so that sufficient ejection stability may not be ensured.

Meanwhile, an ink feeding system disclosed in Japanese Patent No. 3,252,392 has a configuration so as to provide a good efficiency of air bubble discharge of a recording head part. In the ink feeding system, an ink cartridge and a sub-tank are connected to one side and the other side of a common liquid chamber of a recording head, respectively, wherein pressurization of the ink cartridge and atmospheric pressure release of the sub-tank are conducted appropriately so as to move ink between them whereby it is possible to discharge air bubbles in the common liquid chamber of the head.

As described above, the ink feeding system disclosed in Japanese Patent Application Publication No. 2006-088564 may solve the problem of ink refilling but the efficiency of air bubble discharge of the head may be insufficient when the length of the head is increased, and its ejection stability may not be ensured. In the ink feeding system disclosed in Japanese Patent No. 3,252,392 may provide a good efficiency of air bubble discharge of the head but it is impossible to solve the problem of ink refilling.

In such a situation, the inventor has found that there is provided a liquid ejecting device that does not cause insufficient refilling even in the case where ink feeding with a large flow rate is required, is allowed to discharge an air bubble(s) of a recording head sufficiently, and provides the recording head with an improved ejection stability, and an image forming apparatus with the same.

BRIEF SUMMARY

In an aspect of this disclosure, there is provided a liquid ejecting device including a liquid ejecting head including a liquid ejecting nozzle, a head tank configured to store liquid to be fed to the liquid ejecting head, a liquid storing container configured to store liquid to be fed to the head tank, a first liquid sending device configured to send liquid from the liquid storing container to the head tank, a pressure adjusting tank configured to store liquid suctioned from the liquid ejecting head, and a second liquid sending device configured to send liquid from the liquid ejecting head to the pressure adjusting tank, wherein the head tank includes a liquid receiving port configured to receive liquid from the liquid storing container via a liquid receiving valve being opened at a predetermined or less pressure and a liquid feeding port configured to feed liquid to the liquid ejecting head and the liquid ejecting head includes a liquid inflow port communicating with the liquid feeding port and a liquid outflow port communicating with the pressure adjusting tank via the second liquid sending device.

According to another aspect, there is provided an image forming apparatus including the liquid ejecting device as described above.

DETAILED DESCRIPTION OF THE PREFERRED EMBODIMENTS

Figure 1A:
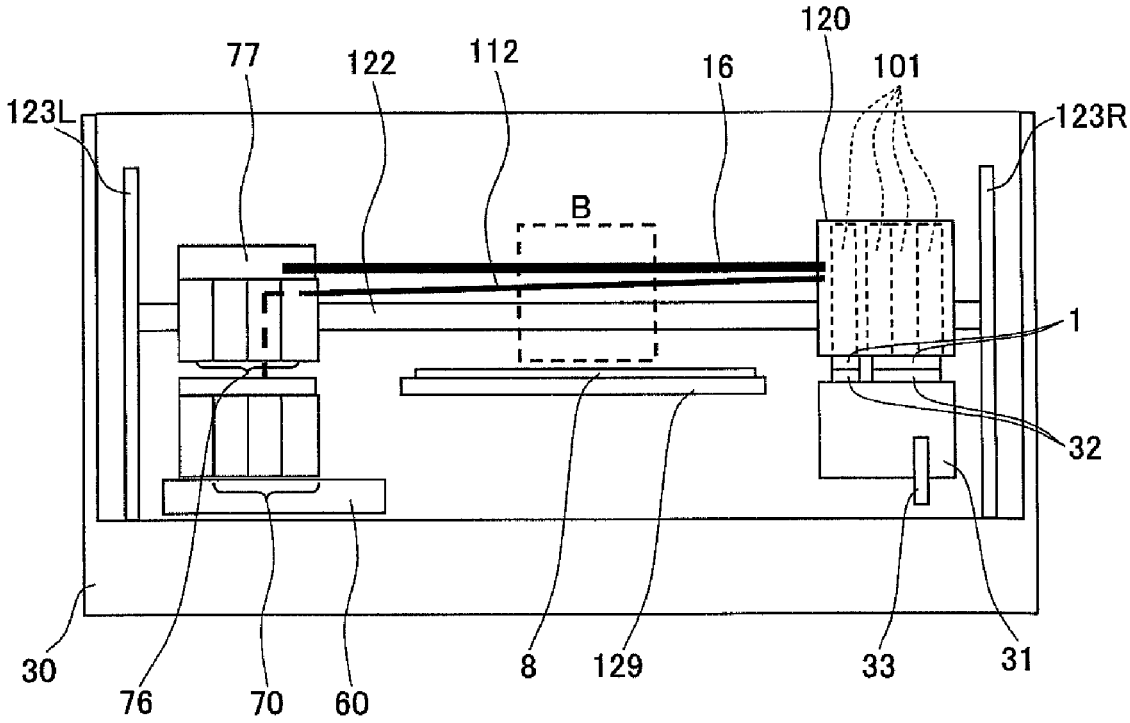
FIGS. 1A, 1B, and 1C are a front view, side view, and top view of an ink jet printer in which a liquid ejecting device according to an embodiment of the present invention is installed, respectively.

A liquid ejecting device according to an embodiment of the present invention includes a liquid ejecting head (also referred to a recording head) including a liquid ejecting nozzle, a head tank for storing liquid to be fed to the liquid ejecting head, a liquid storing container for storing liquid to be fed to the head tank, a first liquid sending device for sending liquid from the liquid storing container to the head tank, a pressure adjusting tank storing liquid auctioned from the liquid ejecting head, and a second liquid sending device for sending liquid from the liquid ejecting head to the pressure adjusting tank. Herein, the head tank includes a liquid receiving port for receiving liquid from the liquid storing container via a liquid receiving valve that is opened at a predetermined or less pressure and a liquid feeding port for feeding liquid to the liquid ejecting head and the liquid ejecting head includes a liquid inflow port communicating with the liquid feeding port and a liquid outflow port communicating with the pressure adjusting tank via the second liquid sending device.

Accordingly, because it is always possible to feed liquid from the liquid storing container on-demand while the inside of a liquid feeding channel of the recording head is maintained at an appropriate negative pressure by the pressure adjusting tank, it is possible to feed liquid to the recording head stably without causing its insufficient feeding even if the flow rate of ejected liquid is increased due to a long-size of the recording head or the like or the flow resistance of a liquid feeding channel is increased due to a long-tube-type of feeding tube or the like. Furthermore, because the recording head is provided with the liquid inflow port and outflow port so that liquid or ink is allowed to flow from the inflow port to the out flow port in the recording head and to be discharged from the outflow port to the pressure adjusting tank, it is possible to discharge air bubbles from the inside of the recording head easily and it is possible to eject from the nozzle liquid which does not contain an air bubble that easily causes abnormal ejection of the recording head. Thereby, it is possible to attain stable and high-speed feeding of a large amount of liquid to the recording head and highly-reliable liquid-ejection of the recording head.

Where the pressure adjusting tank communicates with atmosphere and the level of liquid inside thereof lies at a position lower than the nozzle of the recording head, it is possible to maintain the negative pressure of a recording head part due to the difference between the position of the nozzle and the position of the level of liquid in the pressure adjusting tank. Furthermore, when the liquid receiving port includes a valve, it is possible to control feeding of liquid from the liquid storing container. Thereby, efficient feeding of liquid to the head tank is allowed.

Where the head tank includes an air discharging device, it is possible to remove air in the head tank and it is possible to facilitate feeding of liquid from the liquid storing container. In particular, when liquid is fed on the condition that no liquid is contained in the head tank, air in the head tank is removed by an air discharging device whereby it is possible to feed liquid from the liquid storing container easily.

Where the flow resistance of a flow channel from the head tank to the liquid inflow port is less than the flow resistance of a flow channel from the liquid outflow port to the pressure adjusting tank, inflow of liquid from the head tank is facilitated and back flow of liquid from the pressure adjusting tank to the recording head is suppressed at the time of liquid ejection from the recording head or an operation of cap suction from the nozzle of the recording head, whereby it is possible to maintain the negative pressure of the recording head stably.

Where a flow resistance controlling device for controlling the flow resistance of a flow channel from the liquid outflow port to the pressure adjusting tank is included, it is possible to reduce the flow resistance of a flow channel from the head tank to the liquid inflow port in a required range easily, according to need. Thereby, even when the ejection flow rate of the recording head is increased by increase of the number of nozzles or even when the pressure of nozzle suction caused by capping of the recording head is increased so as to discharge air from the nozzle strongly, it is possible to prevent back flow of liquid from the pressure adjusting tank. Furthermore, it is possible to provide a compact and low-cost pump for air discharge which creates a flow directing the inflow port to outflow port of the recording head so as to discharge air. Where the flow resistance controlling device is configured to be controlled by the working pressure of liquid, air, or the like of the first liquid sending device, no actuator, valve or the like for merely controlling the resistance of fluid is required and no complex control mechanism is required to provide, whereby it is possible to provide a simple equipment.

Where it is possible to provide the first liquid sending device configured to pressurize liquid in the liquid storing container by means of an air pressure, there is no deficiency such as evaporation, thickening, or sticking of liquid when it is used, and it is possible to attain a highly reliable liquid ejecting device.

Where the pressure adjusting tank is configured to include an atmosphere valve which makes an inside thereof to be at a state of non-communication with atmosphere, it is possible to prevent inflow and outflow of liquid from the pressure adjusting tank to the recording head. Where the amount of liquid in the pressure adjusting tank is maintained in a predetermined range, it is possible to retain the negative pressure of the recording head stably and it is possible to attain a highly-reliable liquid ejecting device.

Where there is provided a configuration including a liquid return flow channel which provides the liquid storing container communicating with the pressure adjusting tank and a return flow channel opening or closing valve for opening or closing the liquid return flow channel, it is possible to create a liquid flow directing from the inflow port to outflow port of the recording head so as to discharge air bubbles in the recording head completely and to return excessive liquid stored in the pressure adjusting tank to the liquid storing container, whereby it is possible to intend effective utilization of liquid.

An image forming apparatus including the liquid ejecting device according to an embodiment of the present invention is allowed to ensure a sufficient amount of ink to be fed even if it has a long tube, and it is possible to attain a highly reliable image forming apparatus in which no printed-image deterioration caused by inclusion of an air bubble(s) is found.

Next, specific embodiments of the present invention will be described with reference to the drawings.

First Embodiment

Figure 1B:
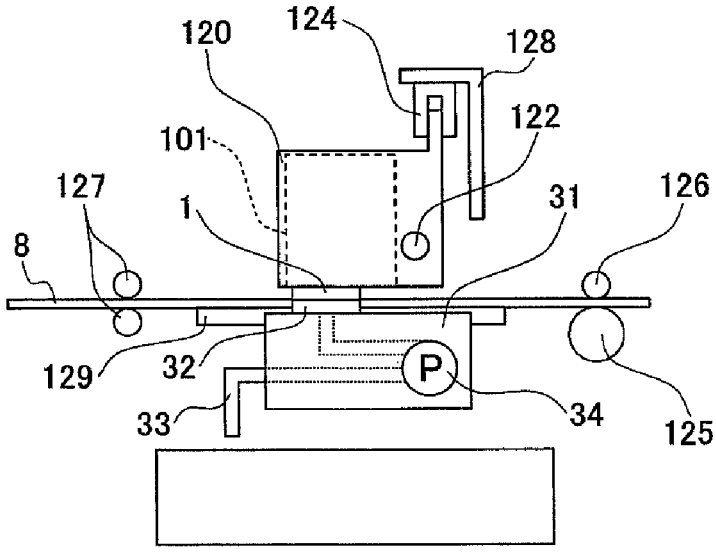
Figure 1C:
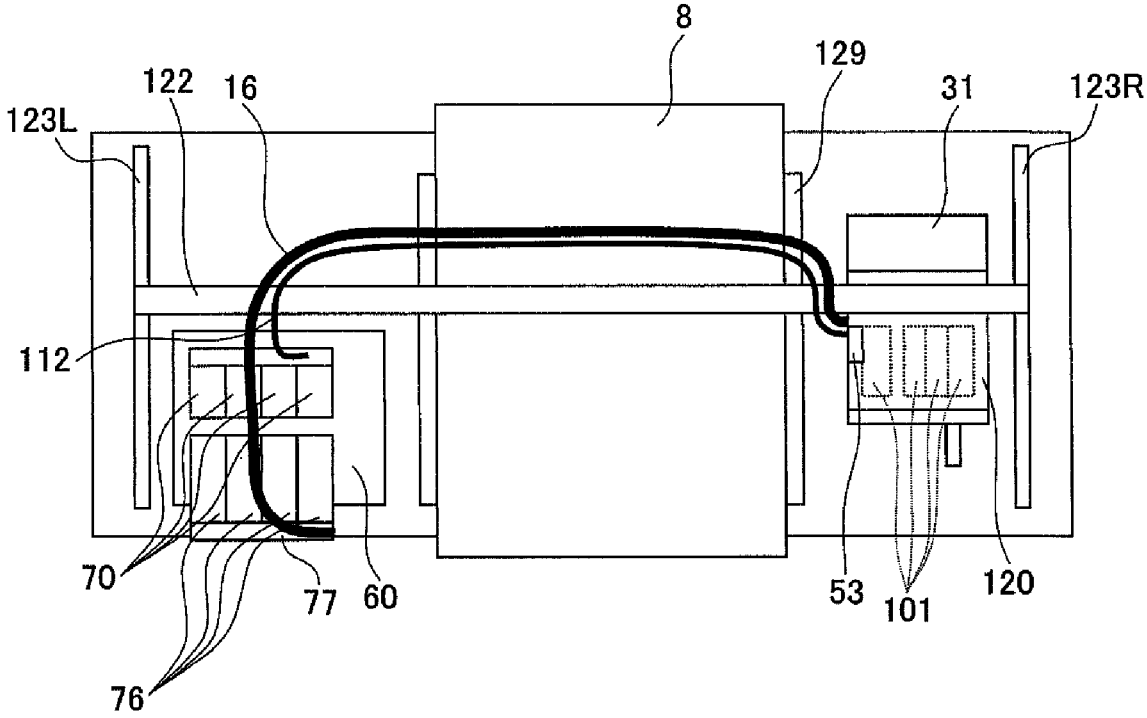

FIGS. 1A, 1B, and 1C illustrate a first embodiment of the present invention. FIGS. 1A, 1B, and 1C are a front view, right side view, and top view illustrating the essential part of an ink jet printer that is an image forming apparatus according to an embodiment of the present invention, which includes a liquid ejecting device according to an embodiment of the present invention. The ink jet printer according to the first embodiment is a preferable example to which a liquid ejecting device according to an embodiment of the present invention is applied, and uses ink as liquid. The ink jet printer holds a carriage 120 by a guide rod 122 and a guide rail 128 which are guide members extending on left and right side plates 123L, 123R such that it is slidable in its main-scanning directions (longitudinal directions of the guide rod) and moves it for scanning in the longitudinal directions of the guide rod 122 (main-scanning directions) by a main-scanning motor and a timing belt which are not illustrated in the figures. On the carriage 120, a recording head 1 that is a liquid ejecting head for ejecting an ink drop of each color such as, for example, yellow (Y), cyan (C), magenta (M), or black (B) is mounted such that plural ink ejection ports are arranged in the directions intersecting the main-scanning directions and the direction of ink drop ejection is downward.

Figure 2:
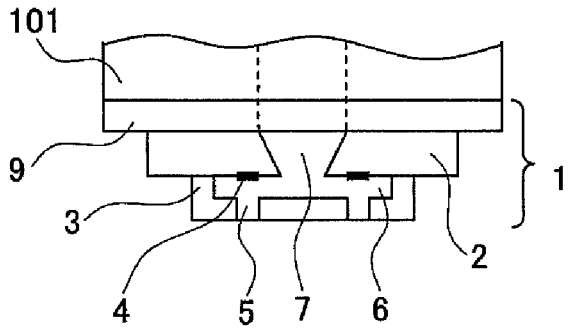
FIG. 2 is an enlarged view of an ejection head.

The recording head 1 is composed of a heater substrate 2 and a liquid chamber forming member 3 as illustrated in an enlarged view of the recording head in FIG. 2 and ejects ink fed through a flow channel formed on a head base member 9 connected to a head tank 101. The recording head 1 is a thermal-type one wherein an ejection pressure is obtained by the film boiling of ink due to driving of a heater 4, and has a side-shooter-type configuration wherein the direction of ink flow to an ejection energy action part (heater part) in a liquid chamber 6 is perpendicular to the central axis of the opening of a nozzle 5. For the recording head 1, there are provided various types such as one obtaining an ejection pressure by deforming a vibration plate using a piezoelectric element, by deforming a vibration plate by means of an electrostatic force, and the like, and any type is allowed to apply to an embodiment of the present invention. Conventionally, whereas a thermal head type has an advantage such that it is easier to make its nozzle density to be a high density than the other types, air bubbles are easily generated in the head in principle and there is a problem of air bubble discharge. However, it is possible for a liquid drop ejecting device according to an embodiment of the present invention to discharge air bubbles generated in the head easily even in case of a thermal head type.

Among the thermal head types, otherwise, an edge shooter type is provided wherein ejection directions are different. In a conventional edge-shooter-type liquid drop ejecting device, there is a problem of a so-called cavitation phenomenon, wherein the heater 4 is gradually broken by impact at a time when air bubbles vanish. In a liquid drop ejecting device according to an embodiment of the present invention, sir bubbles grow even in the edge-shooter-type one and if the air bubbles reach the nozzle 5, the air bubbles communicate with atmosphere, so that an air bubble shrinkage caused by a temperature decrease does not occur. Therefore, the life span of the recording head is not reduced. Furthermore, it is possible to convert energy from the heater 4 into formation of ink drops and the kinetic energy of their ejection more efficiently and a structural advantage is provided such that reset of the meniscus due to ink feeding is also speedy.

The operation of an ink jet printer, mainly, its liquid drop ejecting device according to an embodiment of the present invention, will be described with reference to FIG. 1. Under the carriage 120, a paper sheet 8 on which an image is formed is delivered to a direction (sub-scanning direction) perpendicular to the main-scanning directions. As illustrated in the side view of FIG. 1B, the paper sheet 8 is sandwiched between a delivery roller 125 and a pressure control roller 126, delivered to a character printing part, and sent to an image printing guide part 129. Scanning of the carriage 120 in the main-scanning directions and ink ejection from the recording head 1 are synchronized at an appropriate timing based on image data so that a one-band image is formed on the paper sheet 8. After the formation of the one-band image has been completed, the paper sheet is moved to the sub-scanning direction by a predetermined amount and a recording operation similar to the above-mentioned one is conducted. These operations are conducted repeatedly, so that formation of a one-page image is conducted.

Figure 3A:
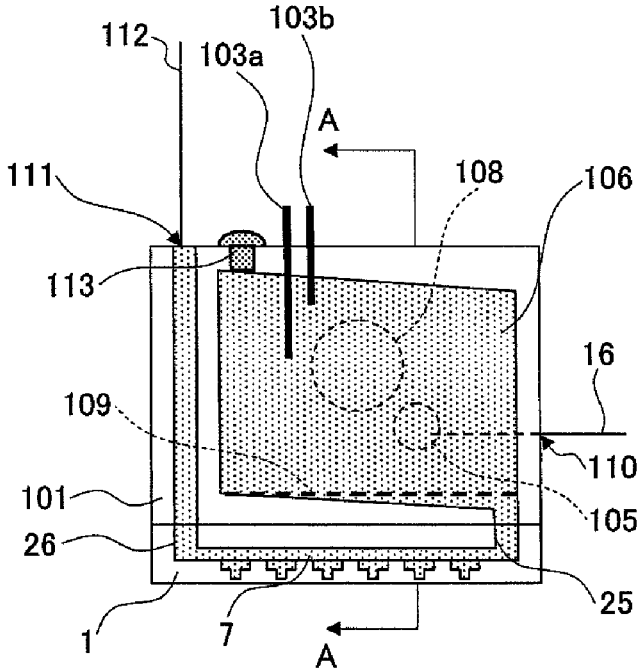
FIGS. 3A, 3B, and 3C are diagrams illustrating an operation of a valve of a head tank.
Figure 3B:
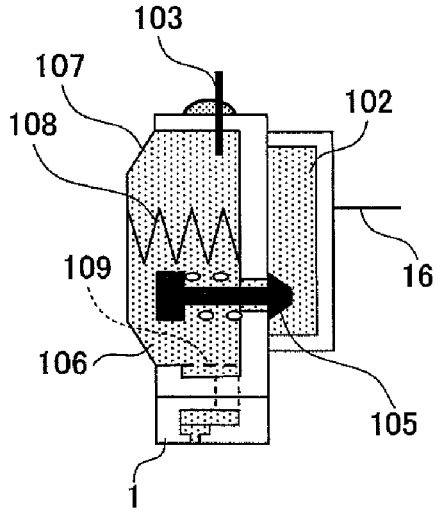

In the liquid drop ejecting device according to the present embodiment, the head tank 101 in which an ink chamber for temporarily storing ink to be ejected is formed is integrally connected to the top of the recording head 1. The term "integrally" used herein also includes that the recording head 1 and the head tank 101 are connected by a tube, a pipe or the like and means that both of them are mounted on the carriage together. The ink chamber of the head tank 101 is connected to a liquid feeding tube 16 that is a first liquid-sending device, and communicates with an ink cartridge 76 that is a liquid storing container. FIGS. 3A and 3B illustrate the structure of the head tank 101. FIG. 3A is a front view of the head tank 101 and FIG. 3B is an AA cross-sectional view of the head tank 101. Additionally, in both figures, depiction of a component may be omitted appropriately and a cross-sectional view may be provided partially, to help someone understand.

Figure 3C:
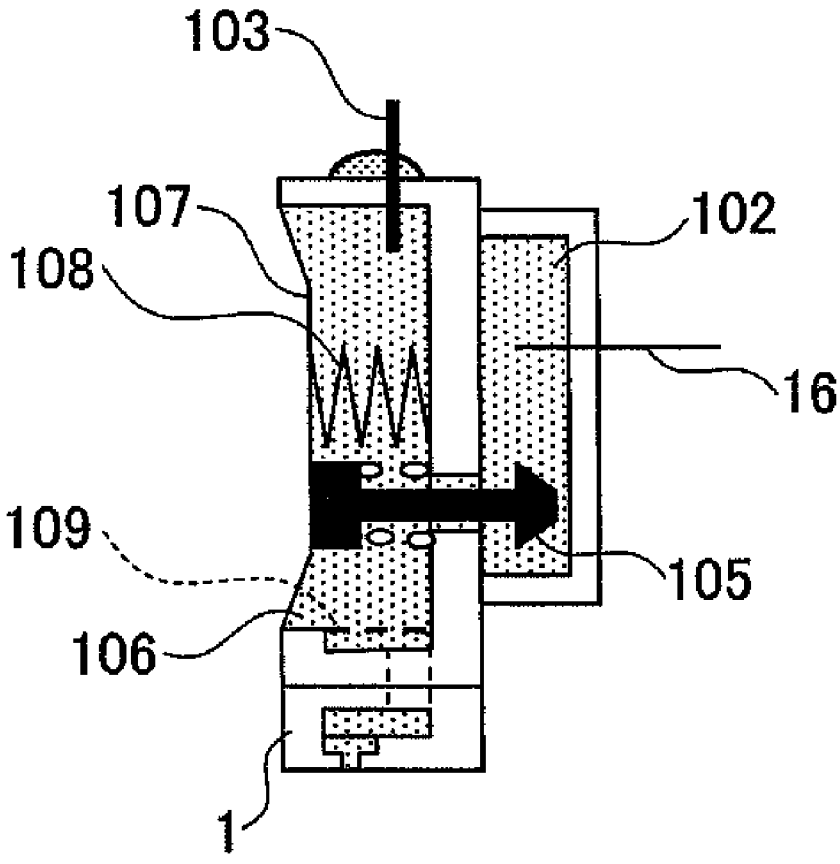

A filter 109 is provided near a connection part with the recording head 1 inside the head tank 101 and is configured to feed to the recording head 1 ink from which contaminants and the like have been removed by its filtration. Furthermore, a film member 107 is provided on one wall surface of the head tank on the one side thereof, and is pressurized by a spring 108 to the directions along which the volume of the head tank 101 could be increased. Thereby, the film member 107 has a convex form expanding to the outside of the head tank, as illustrated in FIG. 3B. The head tank 101 is provided with an ink receiving port that is a liquid receiving port with a liquid receiving valve 105 which is opened or closed according to the operation of the film member 107. The ink receiving port provides an ink chamber 106 communicating with a pressurization chamber 102, wherein the liquid receiving valve 105 controls their communication or non-communication by opening or closing thereof. Usually, the liquid receiving valve 105 of the ink receiving port is closed but when ink in the ink chamber 106 is consumed and reduced as illustrated in FIG. 3C and the internal pressure of the ink chamber 106 is reduced so as to be a predetermined value or less, the film member 107 is deformed to warp toward the inside of the ink chamber 106 so that a working rod of the liquid receiving valve 105 is pressurized to provide an opened state.

An air quantity detecting sensor 103 for detecting an internal air quantity is provided on the top of the head tank. In the head tank 101 illustrated in FIGS. 3A, 3B and 3C, air quantity detecting sensors 103, 103*a* and 103*b* are electrodes whose tips are provided at different heights such that it is possible to detect plural liquid surface states. The ceiling surface of the ink chamber 106 is provided with a gradient and a maintenance port 113 is provided near its top portion, so as to provide a configuration such that removal of air in the head tank or the like is allowed to conduct easily. The maintenance port 113 is made by an elastic body such as a rubber and an attachable/detachable configuration is desirable.

The head tank 101 is provided with a pressurization chamber 102 via an ink feeding port 110 that is a liquid receiving port for receiving liquid. The pressurization chamber 102 is connected to a liquid feeding tube 16 that is a first liquid-sending device illustrated in FIGS. 1A, 1B, and 1C. The ink feeding port 110 includes the liquid receiving valve 105 for incorporating liquid in the head tank according to need.

The bottom portion of the head tank 101 is connected to the recording head 1. In the recording head 1, an ink inflow port 25 as a liquid inflow port and an ink outflow port 26 as a liquid outflow port are provided on both sides of a common flow channel 7. The ink inflow port 25 communicates with the ink chamber 106 through the filter 109 and the ink outflow port 26 communicates with an air bubble discharging port 111.

The air bubble discharging port 111 that is also a liquid outflow port is connected to a discharge tube 112 as a second liquid-sending device. Herein, the discharge tube 112 is thinner than the liquid feeding tube 16. As illustrated in FIGS. 1A, 1B, and 1C, one end of the liquid feeding tube 16 is connected to a cartridge holder 77 fixed on a body and communicates with the ink cartridge 76 through a pipe line not illustrated in the figures in the cartridge holder 77. One end of the discharge tube 112 communicates into the inside of ink stored in a pressure adjusting tank 70 that also serves as an air bubble discharging container fixed on a body.

Because the ink cartridge is pressurized by a pump 78 in the liquid ejecting device according to the present embodiment, no insufficient refilling of ink for the recording head 1 occurs even if the liquid feeding tube 16 is long and the fluid resistance of the tube is large, for example, as in a recording device for printing a character on a wide medium. Furthermore, a consumed quantity of ink is automatically supplied from the ink chamber 106 on which the liquid receiving valve 105 is provided, and if the ink chamber 106 is filled with ink, supply of ink is stopped so that no excessive ink is supplied by a pump 78.

Figure 4:
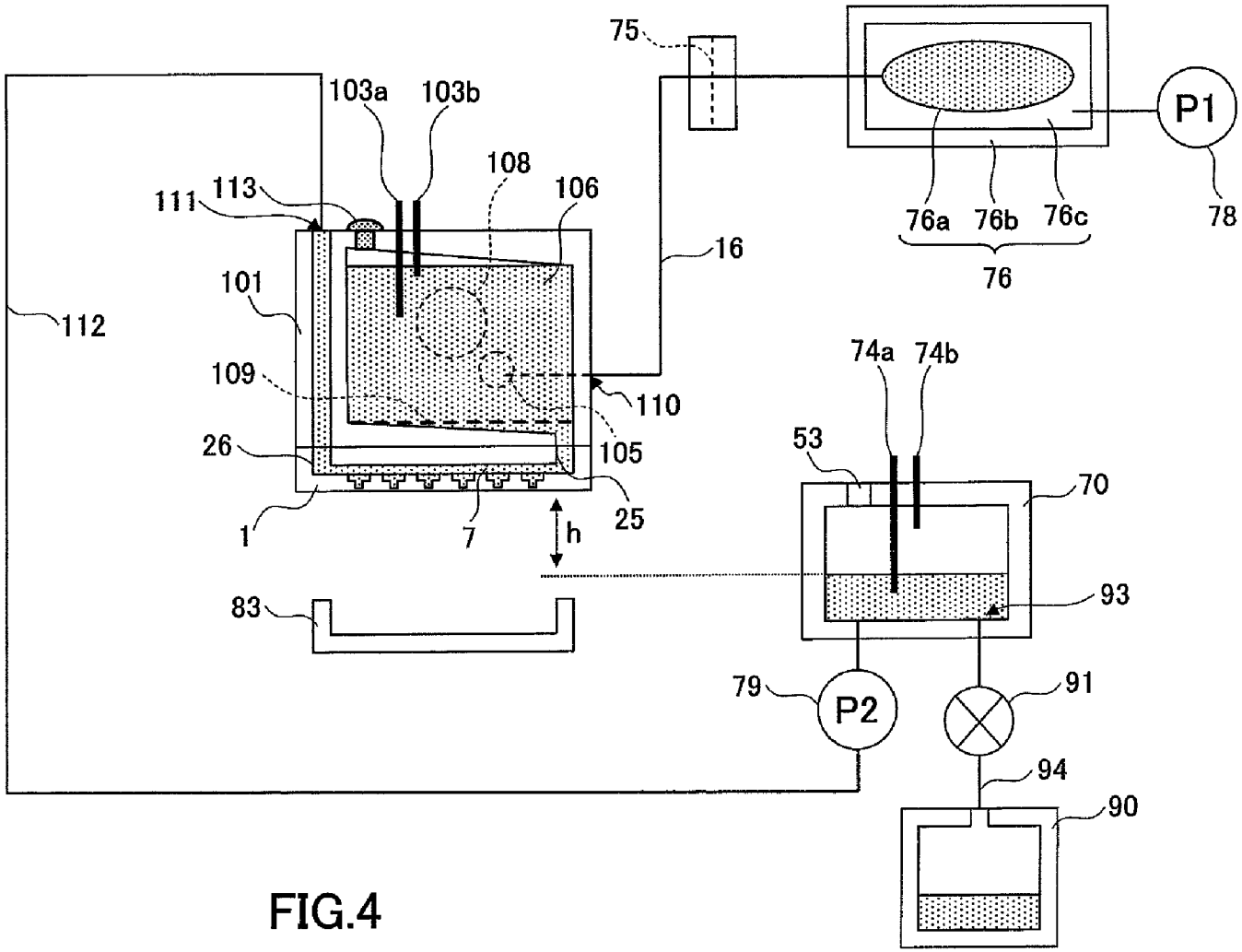
FIG. 4 is a diagram illustrating system (1) for feeding ink to a head tank.

The liquid ejecting device according to the present embodiment is described with reference to FIG. 4. FIG. 4 is a diagram illustrating an ink feeding system for the head tank 1 in the liquid ejecting device according to the present embodiment. The ink cartridge 76 in which ink has been stored includes an ink bag 76*a* in which ink is contained and a case member 76*b* for containing the ink bag 76*a* at an enclosed state, wherein an air space 76*c* that is an enclosed space between the ink bag 76*a* and the case member 76*b* is connected to a pressurizing pump 78 for admitting and releasing air. The ink bag 76*a* is connected to the ink feeding tube (liquid feeding tube) 16. A filter 75 is provided somewhere on the ink feeding tube 16. The ink feeding tube 16 is a plastic tube and is connected to the pressurization chamber 102 provided in the head tank 101 illustrated in FIGS. 3A, 3B, and 3C.

The air bubble discharging port 111 of the tank 101 is connected to the discharge tube 112 that is a plastic tube, and communicates with the pressure adjusting tank 70. A suction pump 79 for suctioning air remaining in the common flow channel 7 of the recording head 1 is provided for the discharge tube 112. On the top of the pressure adjusting tank 70, an air release port 53 is provided to keep it at an atmospheric pressure. Furthermore, a liquid level detecting sensor 74 is provided in the pressure adjusting tank 70 so that it is possible to detect the quantity of ink in the tank. A waste liquid port 93 is provided on the bottom of the pressure adjusting tank 70 and is connected to a drain tube 94 communicating with a waste liquid tank 90 via a waste liquid valve 91.

Figure 5:
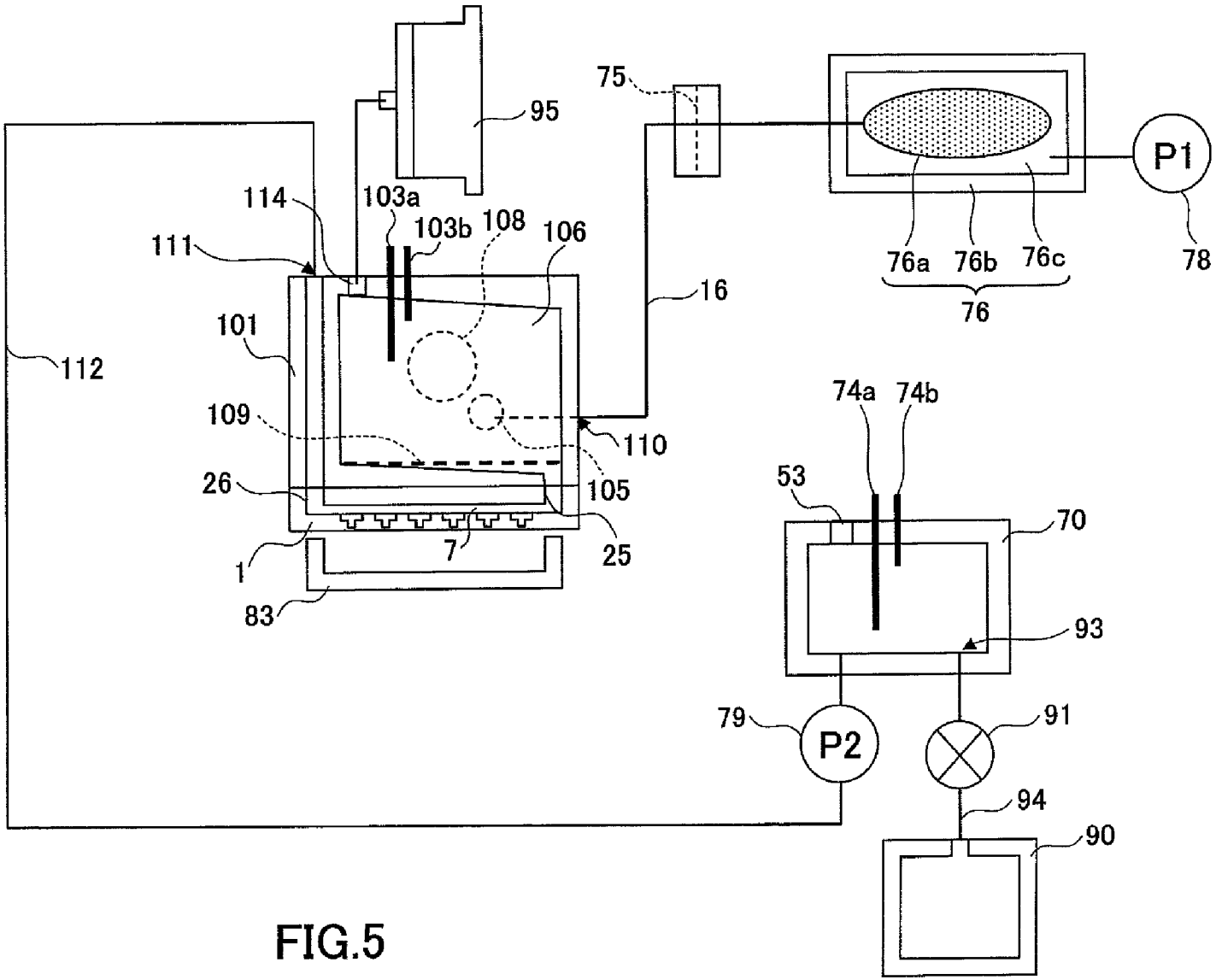
FIG. 5 is a diagram prior to feeding of ink to a head tank.

Initial ink filling for the head tank 101 and recording head 1 of the liquid ejecting device is described with reference to FIGS. 3A, 3B, and 3C, 5, 6, and 7. FIG. 5 illustrates a liquid ejecting device at the state before initial ink filling. For the initial filling, as illustrated in FIG. 5, the maintenance port 113 on the top of the head tank 101 is detached, and instead, a discharge tube 114 provided with a discharge device 95 at one end thereof is connected. For the discharge device 95, it is possible to use an electrical pump or the like, and however a simple suction device based on a manual piston is also sufficient.

Figure 6:
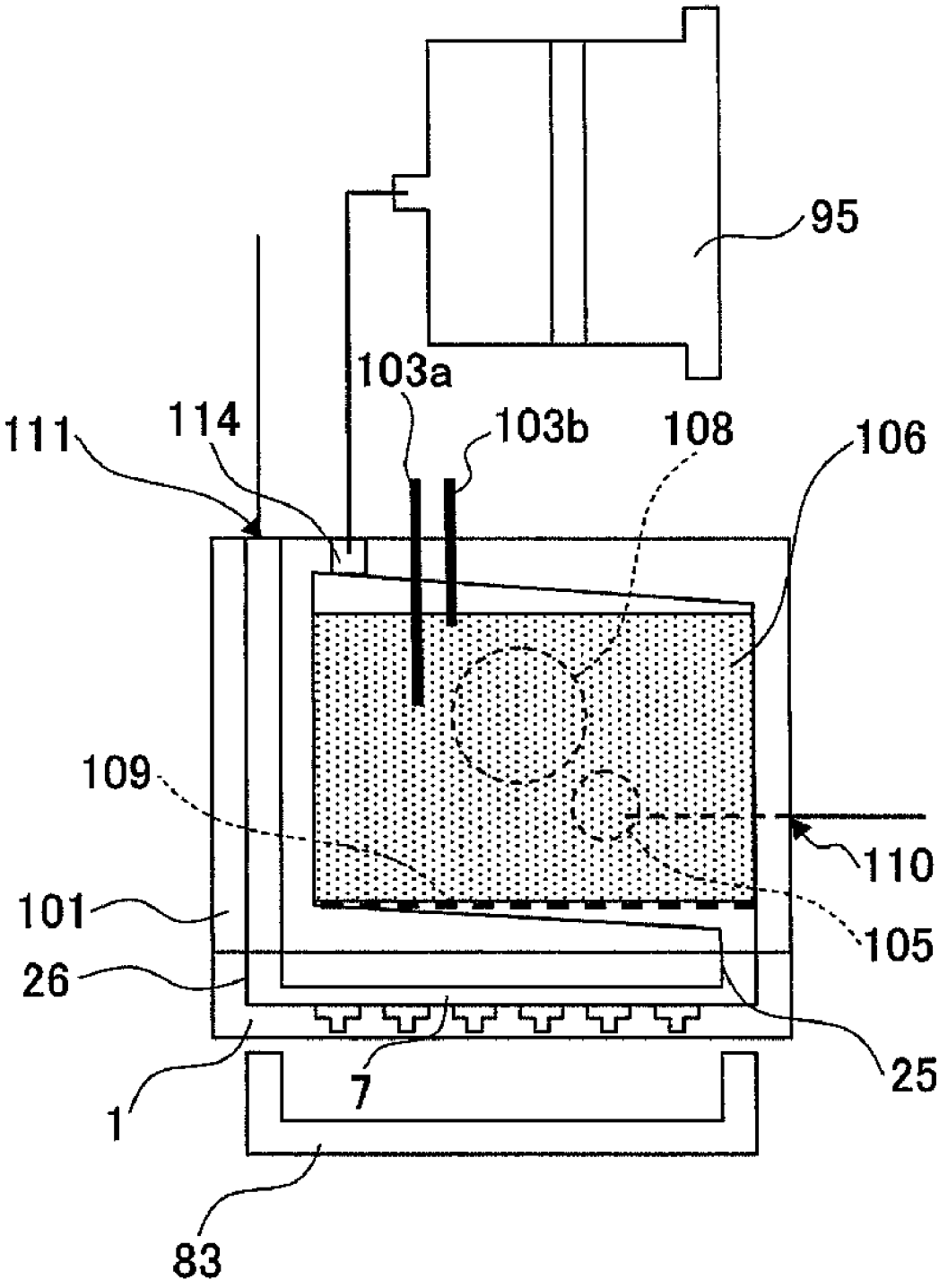
FIG. 6 is a diagram of the state where ink has been fed to a head tank.

First, the pressurizing pump 78 is driven so as to pressurize the ink bag 76*a* of the ink cartridge 76. Herein, because the liquid receiving valve 105 in the head tank 101 is at the closed state as illustrated in FIG. 3B, no ink is sent to the ink chamber 106 of the head tank 101. Then, as illustrated in FIG. 6, a nozzle face is made closely contact with a cap 83 and the discharge device 95 is operated while keeping the space between the nozzle face and the cap 83 at a closed state, whereby air in the head tank 101 is discharged. On this condition, a negative pressure is generated in the ink chamber 106.

The liquid receiving valve 105 provided on the liquid receiving port of the ink chamber 106 is a valve configured to open when the ink chamber 106 comes to a predetermined negative pressure. As a negative pressure is generated in the ink chamber 106 by a discharge operation of the discharge device 95, the liquid receiving valve 105 goes into an opened state. As the liquid receiving valve 105 is opened, ink in the ink cartridge 76 passes through the liquid feeding tube 16 and the pressurization chamber 102 and is fed to the ink chamber 106.

If ink flows into the head tank 101 and the level of ink is raised such that the ink chamber 106 is filled with the ink, the discharge operation of the discharge device 95 is ended. If the discharge operation of the discharge device 95 is ended, the ink chamber 106 has a pressure equal to that of atmosphere, and therefore, the liquid receiving valve 105 is closed to stop the inflow of ink. For a method for detecting a liquid level in the ink chamber 106, the air quantity detecting sensor 103 may be used, and if the ink chamber 106 has a structure that is allowed to view it from its outside, it is possible to conduct detection using an optical sensor or detection may be conducted based on visual observation. Because the ink chamber 106 also goes into a non-negative pressure by stopping the discharge operation of the discharge device 95, inflow of ink from the ink cartridge 76 to the ink chamber 106 is also stopped automatically.

Figure 7:
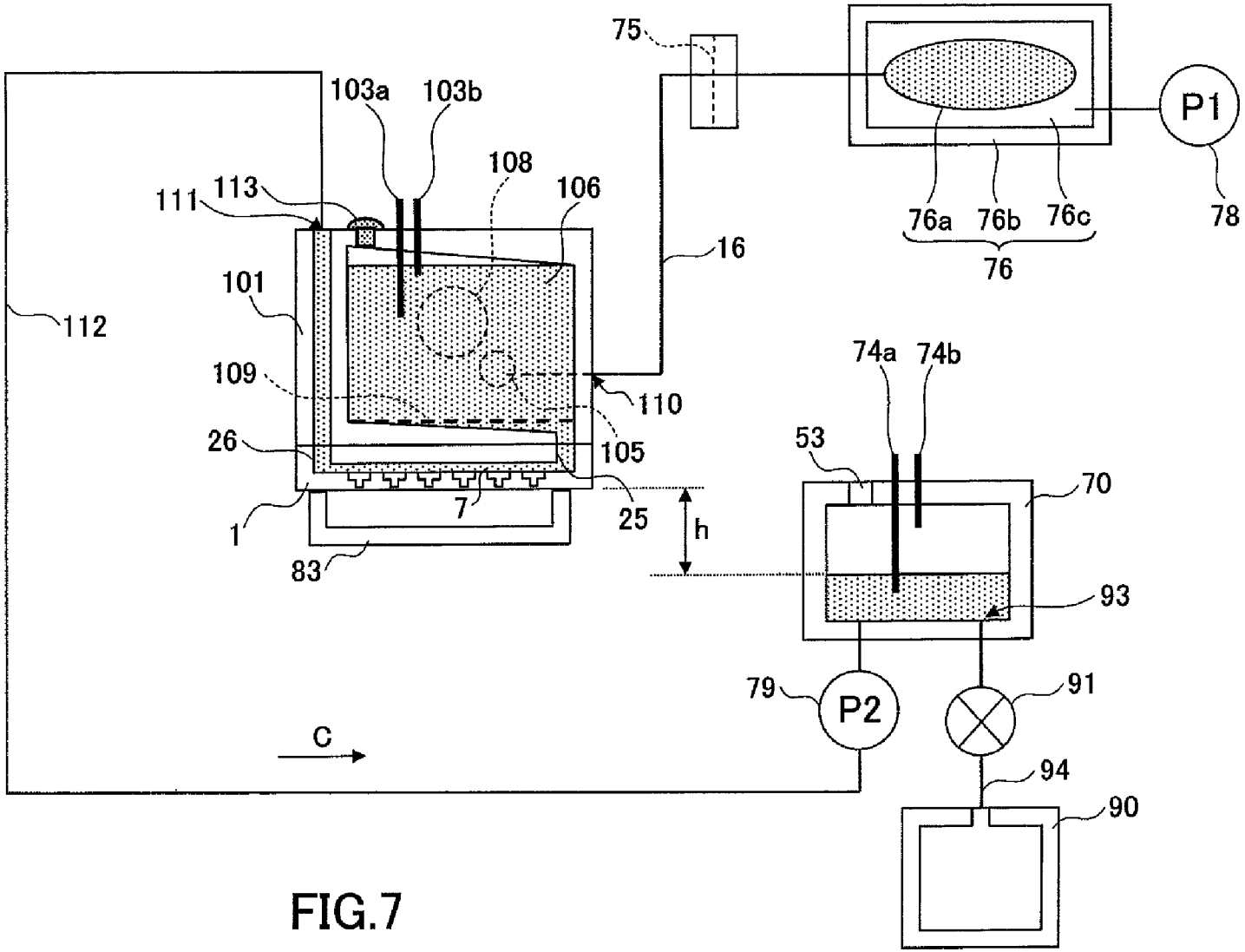
FIG. 7 is a diagram illustrating feeding of ink to a recording head.

Then, as illustrated in FIG. 7, the suction pump 79 is driven so as to suction air and ink in the discharge tube 112 in the direction of arrow C. Due to the suction operation, ink passes through the filter 109, pushes out air in the common flow channel 7 of the recording head 1 to the ink outflow port 26, and is stored in the recording head 1. The ink further passes through the discharge tube 112 and is stored in the pressure adjusting tank 70. Herein, because the air release port 53 is provided on the top of the pressure adjusting tank 70, air present in the recording head 1 or the discharge tube 112 is discharged from the air release port 53.

Because it is possible to drive the suction pump 79 on the condition that the nozzle face is closed by the cap 83 so that the ink chamber goes into a negative pressure, the liquid receiving valve 105 opens and ink is fed from the ink cartridge 76 into the ink chamber 106. When the level of ink in the pressure adjusting tank 70 is raised according to driving of the suction pump 79 and the ink level is detected by the liquid level detecting sensor 74*a*, the suction pump 79 is stopped.

Afterward, the nozzle face is suctioned via the cap 83 by a pump that is connected to the cap 83 and not illustrated in the figure(s) and thus a separate liquid chamber of the recording head 1 is filled with ink.

Finally, the nozzle face is wiped by wiping means that are not illustrated in the figure(s) and an ink meniscus is formed on a nozzle 5 of the recording head 1, thereby completing the initial filling.

At this stage, the level of ink in the pressure adjusting tank 70 is set at a position lower in a distance by "h" than the nozzle 5 of the recording head 1. When the distance "h" is set at a water head difference at which it is possible to obtain an appropriate ejection performance of the recording head 1, it is possible to obtain a stable ink ejection performance. The liquid level detecting sensors 74*a* and 74*b* in the pressure adjusting tank 70 are provided so as to detect a water head difference range in which it is possible to conduct normal ink ejection. Specifically, the tip of the liquid level detecting sensor 74*a* is provided at a position corresponding to the maximum water head difference (for example, a distance of 100 mm from the nozzle face) and the tip of the liquid level detecting sensor 74*b* is provided at a position corresponding to the minimum water head difference (for example, a distance of 20 mm from the nozzle face).

When the working pressure of opening or closing of the liquid receiving valve 105 is set between a pressure corresponding to the above-mentioned maximum water head difference and a pressure corresponding to the minimum water head difference, the level of ink in the pressure adjusting tank 70 is stable between the liquid level detecting sensors 74*a* and 74*b* and the negative pressure in the ink chamber 106 is maintained by the water head difference that is determined at the position "h" of the ink level.

Because the ink cartridge 76 is pressurized by the pump 78 in the liquid ejecting device according to the present embodiment, for example, even if the liquid feeding tube 16 is long and the fluid resistance of the tube is large as in a recording device for printing a character on a wide medium, no insufficient refilling of ink for the recording head 1 occurs. Furthermore, because the liquid receiving valve 105 is provided, no excessive ink is supplied by the pump 78 and a consumed quantity of ink is automatically supplied from the inside of the ink chamber 106.

Moreover, because the pressure adjusting tank 70 for maintaining a proper negative pressure is connected to the common flow channel of the recording head 1, it is possible to conduct stable ink ejection under the proper negative pressure. Furthermore, because the discharge tube 112 is thinner than the liquid feeding tube 16, it is possible to suppress the back flow of ink from the side of the pressure adjusting tank 70 by cap suction for a usual liquid ejection operation or air bubble discharge.

Next, discharge in the case where air bubbles generate or are incorporated in the recording head 1 will be described. Whereas it is possible to discharge air bubbles incorporated near the nozzle 5 or in the separate liquid chamber of the recording head 1 easily by the cap suction of the nozzle face, it may be difficult to discharge air bubbles incorporated in the common flow channel 7 by means of cap suction, in particular, in the case where the recording head 1 is a long-sized one. In the liquid drop ejecting device according to the present embodiment, it is possible to send air bubbles in the common flow channel 7 to the pressure adjusting tank 70 easily by driving the suction pump 79 and to discharge them from the air release port 53.

For such air discharging from the common flow channel 7, it is desirable to close the nozzle face by the cap 83 as illustrated in FIG. 7. It may be possible to avoid inclusion of air bubble from the nozzle more certainly by means of closing of the nozzle face and the suction pressure of the suction pump 79. Additionally, ink in the pressure adjusting tank 70 is increased by an air bubble discharging operation of the suction pump 79. When the level of ink in the pressure adjusting tank 70 reaches a position of liquid level detecting sensor 74*b* which is an upper-limit thereof, the waste liquid valve 91 is opened so as to discharge ink to the waste liquid tank 90, and the amount of ink in the pressure adjusting tank 70 is controlled such that it is a suitable amount. Accordingly, it is possible to keep the negative pressure in the ink chamber 106 at a proper pressure value.

Second Embodiment

Figure 8:
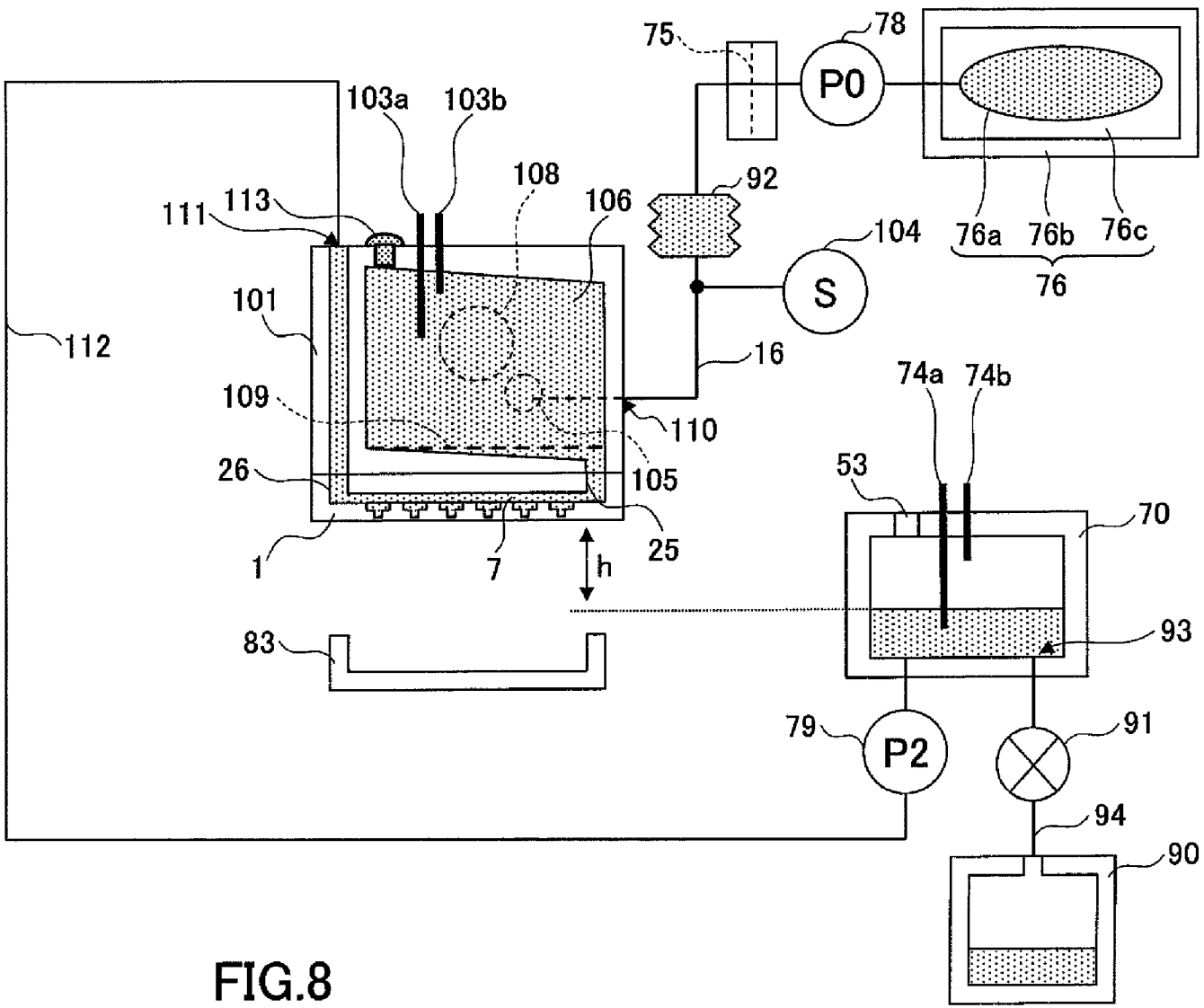
FIG. 8 is a diagram illustrating a system (2) for feeding ink to a head tank.

A liquid ejecting device according to a second embodiment of the present invention will be described with reference to FIG. 8. FIG. 8 illustrates an ink feeding system for a head tank in the liquid ejecting device according to the present embodiment. The present ink feeding system for a head tank has configurations similar to those of the above-mentioned ink feeding system for a head tank as illustrated in FIG. 4, but the configurations of first liquid-sending device and liquid storing container parts of a head tank 101 at its upstream side are different. Whereas the ink feeding system for a head tank as illustrated in FIG. 4 has a configuration such that the ink bag 76*a* of the ink cartridge 76 is pressurized by an air pressure, the ink feeding system for a head tank according to the present embodiment as illustrated in FIG. 8 has a configuration such that a pump 78 is provided at the midpoint of an ink feeding tube 16 and ink liquid is sent from an ink cartridge 76 to the head tank 101 by the pump 78. The ink feeding tube 16 is connected to a pressure sensor 104 and the pump 78 is driven so as to maintain a constant pressure during printing a character.

For the pump 78, a bidirectional-liquid-sending-type one such as a tubing pump is preferable. Because the liquid feeding tube 16 is interposed by an extendable tank 92 whose volume is changeable and ink liquid is sent in bidirectionally and alternately by the pump 78 during printing no character so that the ink is moved back and forth and stirred between the extendable tank 92 and the ink cartridge 76, a deficiency such as sedimentation of a pigment component does not occur whereby it is possible to keep the ink quality constant and it is possible to conduct ink feeding with a stable quality.

Third Embodiment

Figure 9:
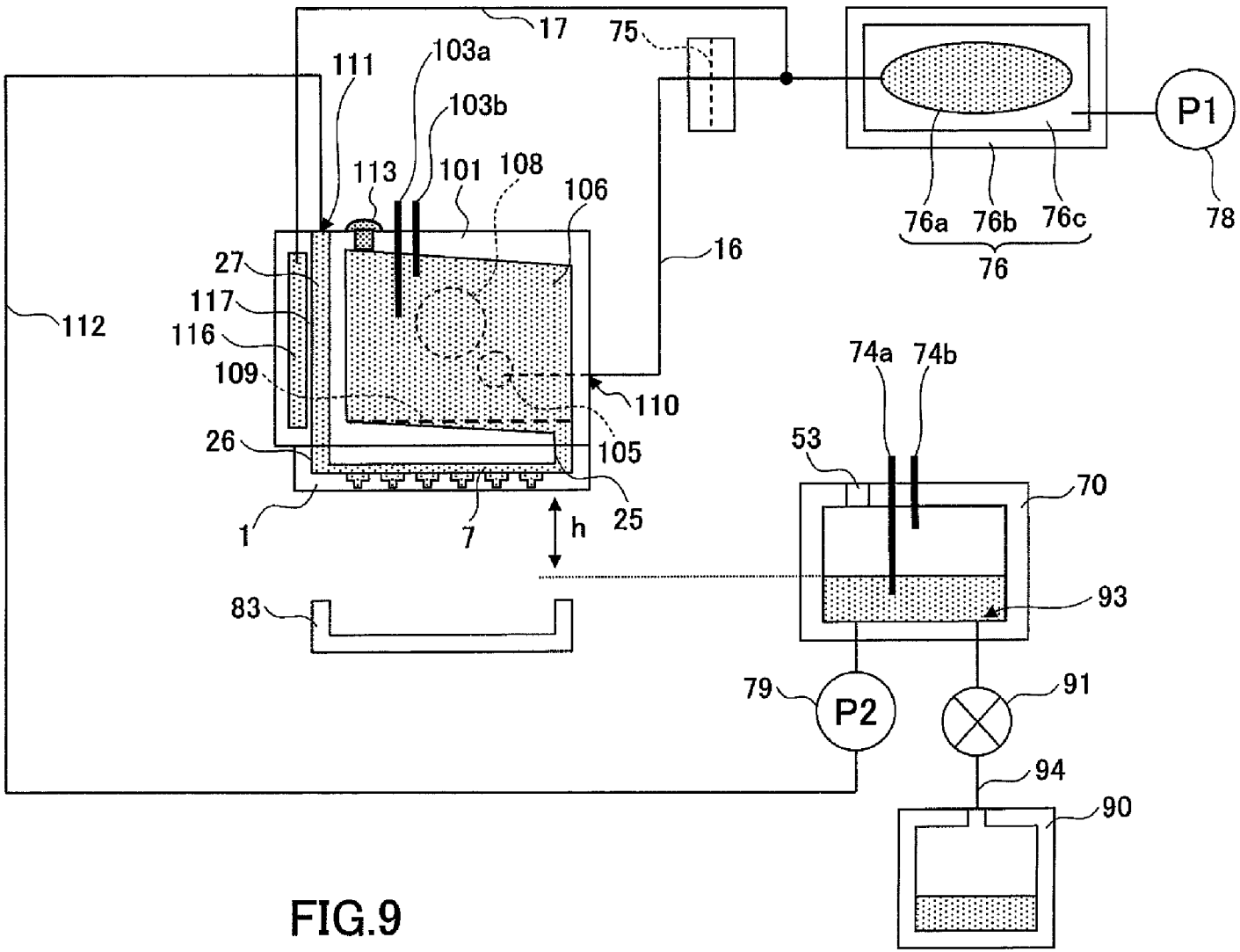
FIG. 9 is a diagram illustrating a system (3) for feeding ink to a head tank.

A liquid ejecting device according to a third embodiment of the present invention will be described with reference to FIG. 9. FIG. 9 illustrates an ink feeding system for a head tank in the liquid ejecting device according to the present embodiment. The present ink feeding system for a head tank has configurations similar to those of the above-mentioned ink feeding system for a head tank as illustrated in FIG. 4 and is different in that a working chamber for changing the flow resistance of a flow channel is provided in a flow channel at the downstream side of an ink outflow port 26 of a recording head 1.

For a head tank 101 in the ink feeding system for head tank as illustrated in FIG. 9, the working chamber 116 is provided adjacent to an air bubble discharging channel 27 providing an air bubble discharging port 111 communicating with the ink outflow port 26 of the recording head 1. The working chamber 116 and the air bubble discharging channel 27 are partitioned by an elastic wall 117 with elasticity. The working chamber 116 communicates with an ink feeding tube 16 via a working fluid feeding tube 17.

Figure 10:
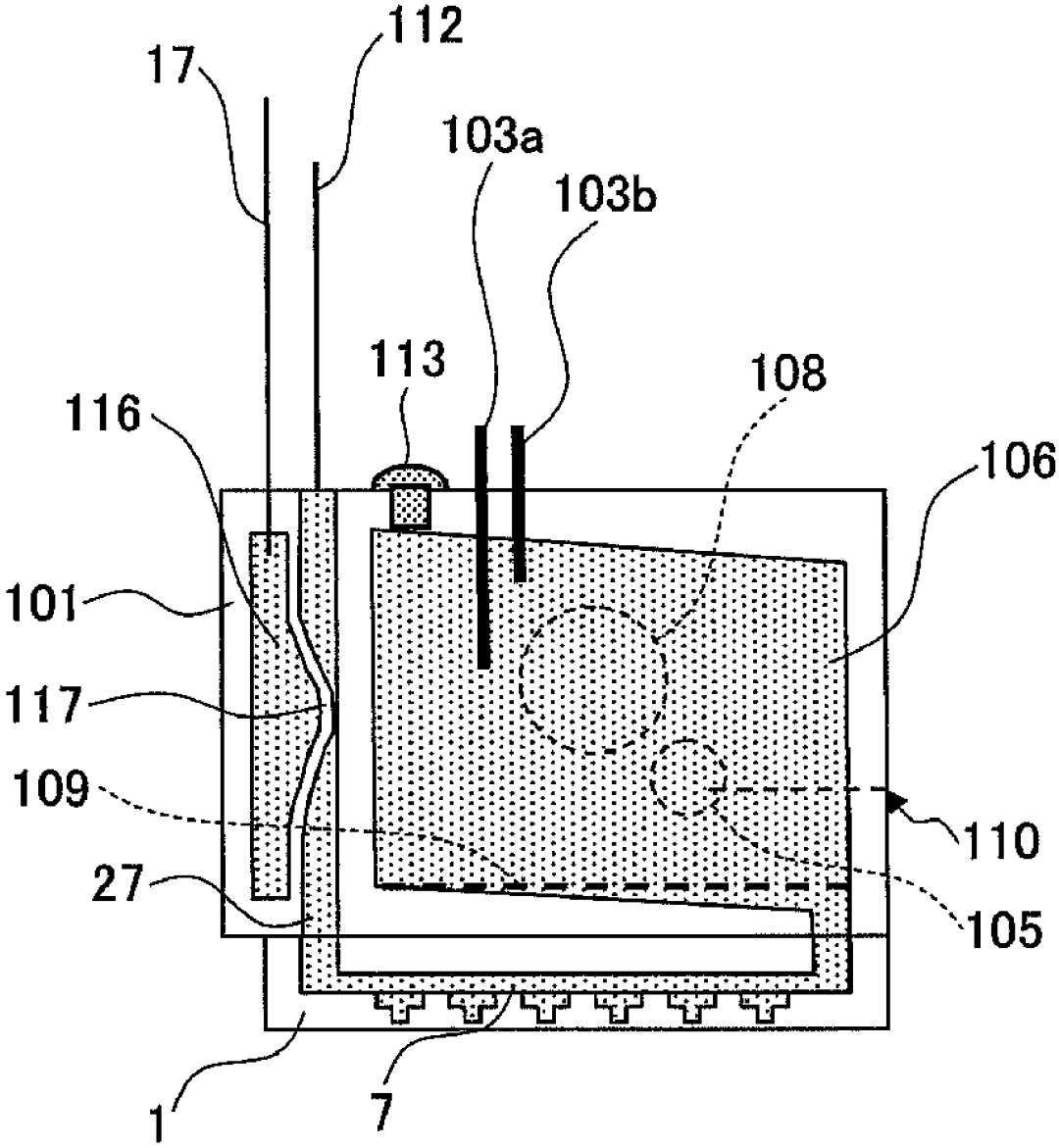
FIG. 10 is a diagram illustrating an operation for preventing back flow of ink due to an elastic wall of a head tank.

When the pump 78 is driven in order to assist refilling for the recording head 1 during printing a character in the present ink feeding system, an ink bag 76*a* is not only pressurized but also the internal pressure of the working chamber 116 is raised, whereby the elastic wall 117 is deformed and the air bubble discharging channel 27 is narrowed, as illustrated in FIG. 10. Thereby, even if a discharge tube 112 is thickened so as to reduce the fluid resistance of the discharge channel, the air bubble discharging channel 27 is closed by the elastic wall 117 whereby it is possible to prevent backflow of ink from a pressure adjusting tank 70.

At a time of air bubble discharging from a common flow channel 7, only a suction pump 79 is driven without driving the pump 78 so that the elastic wall 117 is not deformed and the air bubble discharging channel is not narrowed. Herein, because there is no ink pressurization due to the pump 78, it is possible to reduce the fluid resistance of the discharge channel compared to that of the ink feeding systems having the configurations illustrated in FIG. 4 and FIG. 8 and therefore it is possible to make the suction pump 79 more compact and inexpensive.

Fourth Embodiment

Figure 11:
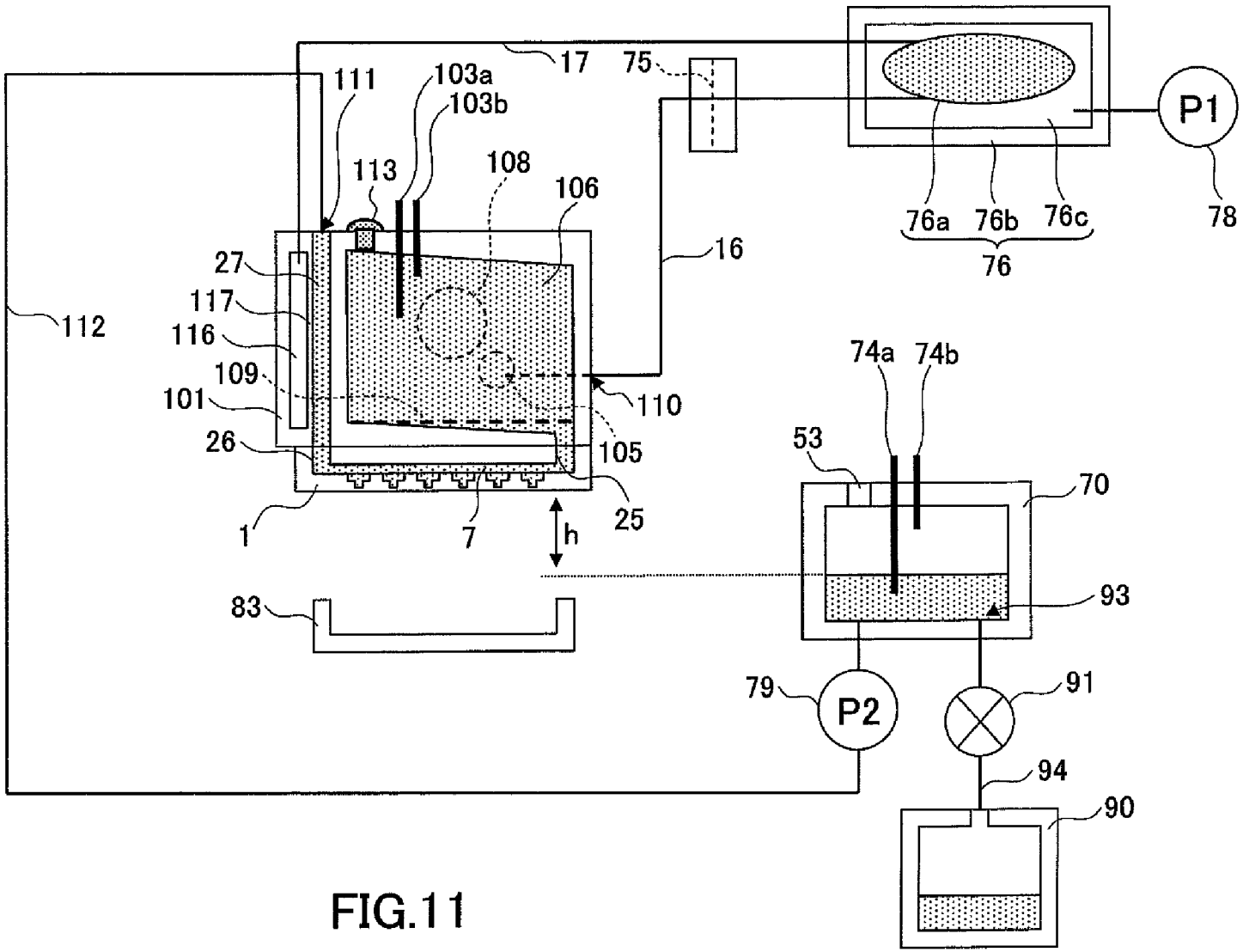
FIG. 11 is a diagram illustrating a system (4) for feeding ink to a head tank.

A liquid ejecting device according to a fourth embodiment of the present invention will be described with reference to FIG. 11. FIG. 11 illustrates an ink feeding system for a head tank in the liquid ejecting device according to the present embodiment. The present ink feeding system for a head tank is a variation of the above-mentioned ink feeding system for a head tank as illustrated in FIG. 9, and is different from that of FIG. 9 in that the configurations of first liquid-sending device and liquid storing container parts of a head tank 101 at the upstream side thereof are similar to those of the ink feeding system for head tank as illustrated in FIG. 4 and a working chamber 116 communicates with an air space 76*c* of an ink cartridge 76.

Figure 12:
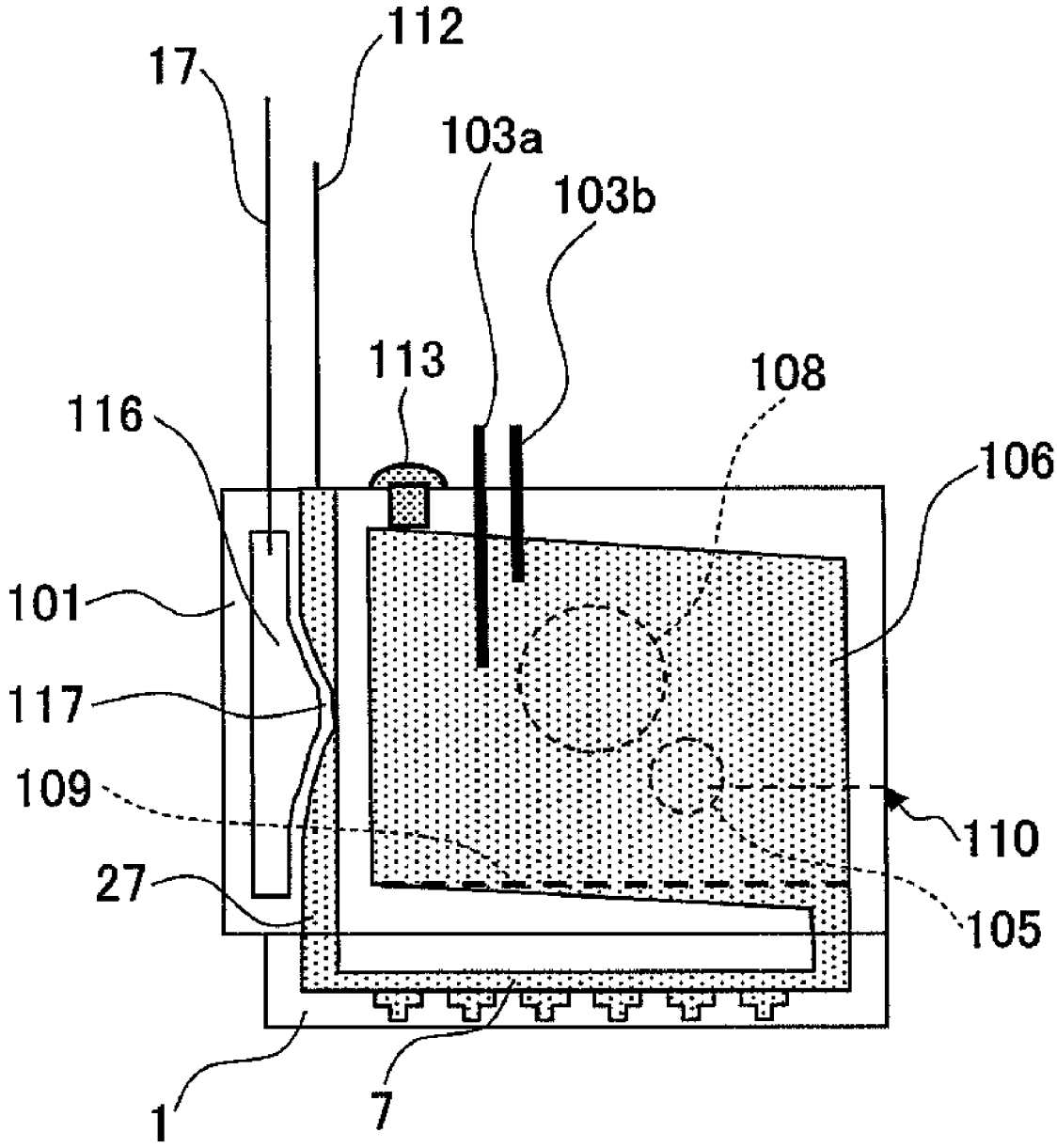
FIG. 12 is a diagram illustrating an operation for preventing back flow of ink due to an elastic wall of a head tank.

In the ink feeding system for head tank as illustrated in FIG. 11, the working chamber 116 communicates with the air space 76*c* of the ink cartridge 76 via a working fluid feeding tube 17. Air is sent from the air space 76*c* to the working chamber 116 by driving a pump 78 for pressurizing an ink bag 76*a*, whereby an elastic wall 117 is deformed and an air bubble discharging channel 27 is closed, as illustrated in FIG. 12. When gas is used for a working fluid as in the present embodiment, there is no problem such as evaporation, thickening, sticking or the like of ink, which is different from the configuration such that ink is used for a working fluid as in the fourth embodiment, and it is possible to use an inexpensive material for the working fluid feeding tube 17.

Fifth Embodiment

Figure 13:
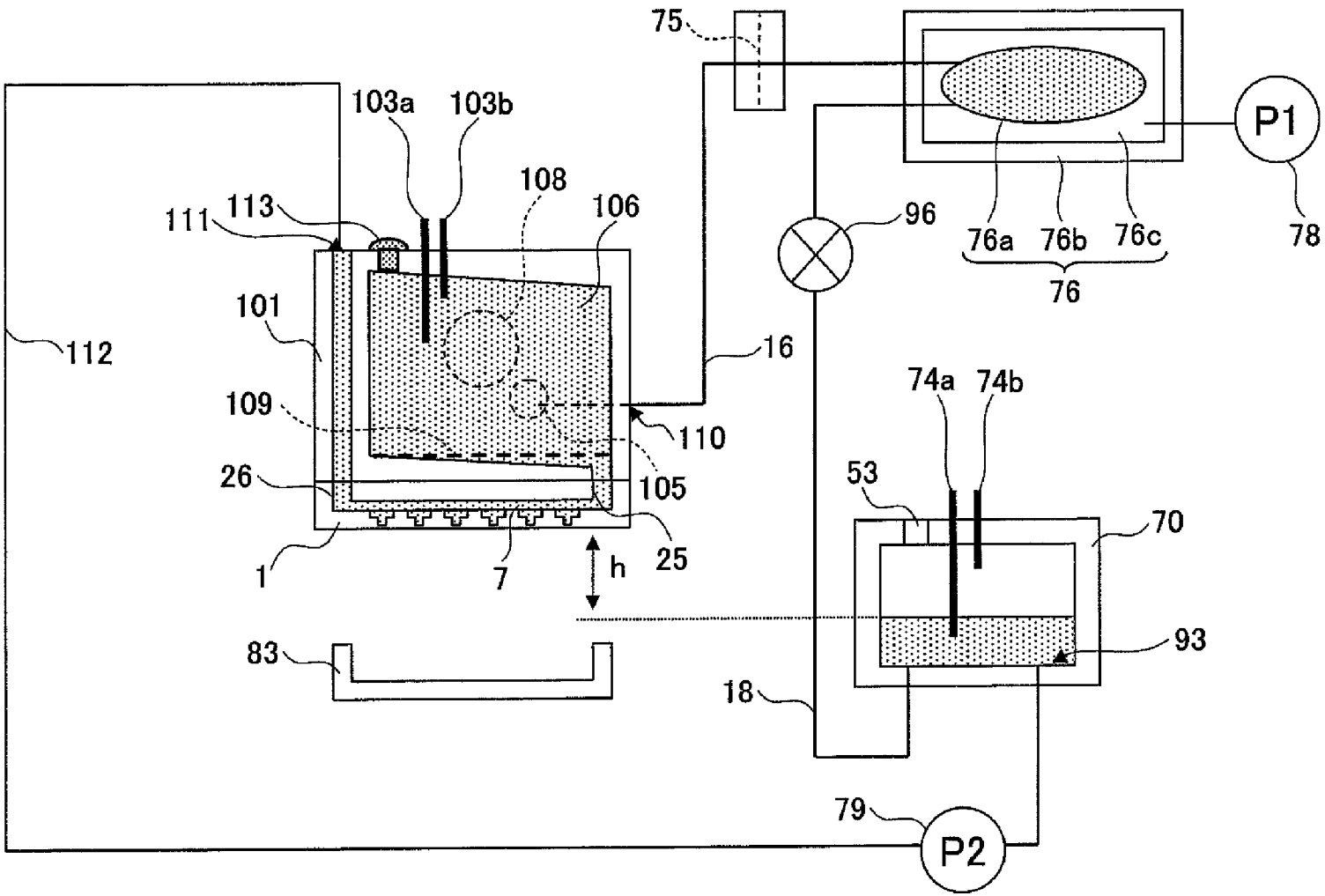
FIG. 13 is a diagram illustrating a system (5) for feeding ink to a head tank.

A liquid ejecting device according to a fifth embodiment of the present invention will be described with reference to FIG. 13. FIG. 13 illustrates an ink feeding system for a head tank in the liquid ejecting device according to the present embodiment. The ink feeding system according to the present embodiment has a configuration similar to that of the ink feeding system of the first embodiment illustrated in FIG. 4, and is different in a configuration such that a pressure adjusting tank 70 communicates with an ink bag 76*a* of a liquid storing container via a return flow channel opening or closing valve 96 and a pump 78 has a discharging function.

Similarly to the second embodiment, the ink feeding system for a head tank as illustrated in FIG. 13 has a configuration such that an air bubble discharging port 111 of a head tank 101 is connected to a discharge tube 112 and it is possible to send air in a common flow channel 7 of a recording head 1 to a pressure adjusting tank 70 by a suction pump 79 arranged at the midpoint of the discharge tube 112.

The bottom of the pressure adjusting tank 70 of the present embodiment is connected to a liquid return flow channel 18 and communicates with the ink bag 76*a* via the return flow channel opening or closing valve 96. The return flow channel opening or closing valve 96 is commonly a valve at its closed state.

Whereas the pressure adjusting tank 70 is connected to the waste liquid tank 90 via the drain tube 94 and when the level of ink in the pressure adjusting tank 70 reaches the liquid level detecting sensor 74*b* by a discharging operation of the recording head 1, the ink is discharged into the waste liquid tank 90 and the level of liquid in the pressure adjusting tank 70 is retained between the two liquid level detecting sensors 74*a* and 74*b* in the ink feeding system of the second embodiment, the pump 78 is operated for discharging and the return flow channel opening or closing valve 96 is opened when the level of liquid in the pressure adjusting tank 70 reaches a liquid level detecting sensor 74*b* in the present embodiment. Thereby, ink in the pressure adjusting tank 70 is returned into the ink bag 76*a* and the level of liquid in the pressure adjusting tank 70 is lowered. After the liquid level detecting sensor 74 detects that the level of in the pressure adjusting tank 70 is lowered to its proper position, the return flow channel opening or closing valve 96 is closed and the pump 78 is stopped. Because, in the ink feeding system of the present embodiment, it is possible to reuse ink as is wasted in the above-mentioned ink feeding system, it is possible to attain a liquid ejecting device with a low running cost.

Sixth Embodiment

A sixth embodiment of the present invention is an image forming apparatus with the liquid ejecting device described for any one of the first to fifth embodiments described hereinbefore. The image forming apparatus includes a liquid ejecting device according to an embodiment of the present invention as described for any one of the first to fifth embodiments in an image forming apparatus using ink, such as a conventional ink jet printer, a printer, a copying machine, a facsimile apparatus, and the like.

It is possible to utilize a liquid ejecting device according to an embodiment of the present invention as a liquid ejecting device for ejecting liquid other than ink, for example, a DNA sample, a resist, a pattern material, or the like, as well as a liquid ejecting device for ejecting ink. Furthermore, it is possible to apply not only to a narrowly-defined image forming apparatus but also to a pattern forming apparatus for forming a pattern such as a DNA sample or a resist.

According to an embodiment of the present invention, it is possible to provide a liquid ejecting device that does not cause insufficient refilling even in the case where ink feeding with a large flow rate is required, is allowed to discharge an air bubble(s) of a recording head sufficiently, and provides the recording head with an improved ejection stability, and an image forming apparatus with the same.

Although the illustrative embodiments and specific examples of the present invention have been described with reference to the accompanying drawings, the present invention is not limited to any of the illustrative embodiments and specific examples and the illustrative embodiments and specific examples may be altered, modified, or combined without departing from the scope of the present invention.

The present application claims the benefit of its priority based on Japanese Patent Application No. 2008-136842 filed on May 26, 2008 in Japan, the entire contents of which are hereby incorporated by reference herein.

What is claimed is:

1. A liquid ejecting device comprising:

a liquid ejecting head comprising a liquid ejecting nozzle;

a head tank configured to store liquid to be fed to the liquid ejecting head;

a liquid storing container configured to store liquid to be fed to the head tank;

a first liquid sending device configured to send liquid from the liquid storing container to the head tank;

a suction pump configured to suction liquid from the liquid ejecting head;

a pressure adjusting tank configured to store liquid suctioned from the liquid ejecting head; and a second liquid sending device configured to send liquid from the liquid ejecting head to the pressure adjusting tank, wherein the head tank comprises a liquid receiving port configured to receive liquid from the liquid storing container via a liquid receiving valve that is opened when a pressure in the head tank is at or below a predetermined pressure, the head tank further comprises a liquid feeding port configured to feed liquid to the liquid ejecting head, the liquid ejecting head comprises a liquid inflow port communicating with the liquid feeding port, and the liquid ejecting head further comprises a liquid outflow port communicating with the pressure adjusting tank via the second liquid sending device, and wherein the pressure adjusting tank communicates with atmosphere and a level of liquid inside thereof lies at a position lower than the nozzle by a distance set between a maximum water head difference and a minimum water head difference, and a working pressure of opening or closing of the liquid receiving valve is set between a pressure corresponding to the maximum water head difference and a pressure corresponding to the minimum water head difference.

2. The liquid ejecting device as claimed in claim 1, wherein the head tank comprises an air discharging device.

3. The liquid ejecting device as claimed in claim 1, wherein a flow resistance of a flow channel from the head tank to the liquid inflow port is less than a flow resistance of a flow channel from the liquid outflow port to the pressure adjusting tank.

4. The liquid ejecting device as claimed in claim 1, further comprising a flow resistance controlling device configured to control a flow resistance of a flow channel from the liquid outflow port to the pressure adjusting tank.

5. The liquid ejecting device as claimed in claim 4, wherein the flow resistance controlling device is controlled by the first liquid sending device.

6. The liquid ejecting device as claimed in claim 1, wherein the first liquid sending device is provided with a pressurizing pump configured to pressurize liquid in the liquid storing container by means of an air pressure.

7. The liquid ejecting device as claimed in claim 1, wherein the pressure adjusting tank comprises an atmosphere valve configured to provide an inside thereof at a state of non-communication with atmosphere.

8. The liquid ejecting device as claimed in claim 1, further comprising a liquid return flow channel configured to provide the liquid storing container communicating with the pressure adjusting tank and a return flow channel opening or closing valve configured to open or close the liquid return flow channel.

9. The liquid ejecting device as claimed in claim 1, wherein the liquid is ink.

10. The liquid ejecting device as claimed in claim 1, wherein the pressure adjusting tank further comprises a first liquid level detecting sensor and a second liquid level detecting sensor, a tip of the first liquid level detecting sensor being disposed at a first position that is a first distance from the liquid ejecting nozzle corresponding to the maximum water head difference, and a tip of the second liquid level detecting sensor being disposed at a second position that is a second distance from the liquid ejecting nozzle corresponding to the minimum water head difference.

11. The liquid ejecting device as claimed in claim 1, wherein the head tank includes a liquid chamber to contain the liquid to be fed from the head tank to the liquid ejecting head, the liquid chamber is configured to receive liquid from the liquid storing container through the liquid receiving port of the head tank, and the liquid receiving valve is configured to open when the liquid chamber comes to a predetermined negative pressure.

12. The liquid ejecting device as claimed in claim 11, wherein in a case that a distance between a liquid level of the liquid in the pressure adjusting tank and the liquid ejecting nozzle exceeds the maximum water head difference, the suction pump causes a negative pressure in the liquid chamber, by suctioning liquid from the liquid ejecting head to the pressure adjusting tank.

13. An image forming apparatus comprising a liquid ejecting device, the liquid ejecting device comprising:

a liquid ejecting head comprising a liquid ejecting nozzle;

a head tank configured to store liquid to be fed to the liquid ejecting head;

a liquid storing container configured to store liquid to be fed to the head tank;

a first liquid sending device configured to send liquid from the liquid storing container to the head tank;

a suction pump configured to suction liquid from the liquid ejecting head;

a pressure adjusting tank configured to store liquid suctioned from the liquid ejecting head; and a second liquid sending device configured to send liquid from the liquid ejecting head to the pressure adjusting tank, wherein the head tank comprises a liquid receiving port configured to receive liquid from the liquid storing container via a liquid receiving valve that is opened when a pressure in the head tank is at or below a predetermined pressure, the head tank further comprises a liquid feeding port configured to feed liquid to the liquid ejecting head, the liquid ejecting head comprises a liquid inflow port communicating with the liquid feeding port, the liquid ejecting head further comprises a liquid outflow port communicating with the pressure adjusting tank via the second liquid sending device, the pressure adjusting tank communicates with atmosphere, and a level of liquid inside of the pressure adjusting tank lies at a position lower than the nozzle by a distance set between a maximum water head difference and a minimum water head difference, and a working pressure of opening or closing of the liquid receiving valve is set between a pressure corresponding to the maximum water head difference and a pressure corresponding to the minimum water head difference.

14. The image forming apparatus as claimed in claim 13, wherein the pressure adjusting tank further comprises a first liquid level detecting sensor and a second liquid level detecting sensor, a tip of the first liquid level detecting sensor being disposed at a first position that is a first distance from the liquid ejecting nozzle corresponding to the maximum water head difference, and a tip of the second liquid level detecting sensor being disposed at a second position that is a second distance from the liquid ejecting nozzle corresponding to the minimum water head difference.

15. The image forming apparatus as claimed in claim 13, wherein the head tank includes a liquid chamber to contain the liquid to be fed from the head tank to the liquid ejecting head, the liquid chamber is configured to receive liquid from the liquid storing container through the liquid receiving port of the head tank, and the liquid receiving valve is configured to open when the liquid chamber comes to a predetermined negative pressure.

16. The image forming apparatus as claimed in claim 13, wherein in a case that a distance between a liquid level of the liquid in the pressure adjusting tank and the liquid ejecting nozzle exceeds the maximum water head difference, the suction pump causes a negative pressure in the liquid chamber, by suctioning liquid from the liquid ejecting head to the pressure adjusting tank.

* * * * *